US005816865A

United States Patent [19]

Chadbourne

[11] Patent Number: 5,816,865

[45] Date of Patent: Oct. 6, 1998

[54] WEDGE CONNECTOR SHELL WITH FLARED ENDS AND BURRS

[75] Inventor: Richard Chadbourne, Merrimack, N.H.

[73] Assignee: Framatome Connectors USA Inc., Fairfield, Conn.

[21] Appl. No.: 839,070

[22] Filed: Apr. 23, 1997

[51] Int. Cl.[6] ..... H01R 4/50

[52] U.S. Cl. ..... 439/783

[58] Field of Search ..... 439/783, 863

[56] References Cited

U.S. PATENT DOCUMENTS

| | | | |
|---|---|---|---|
| 4,650,273 | 3/1987 | Roosdrop | 439/783 |
| 5,006,081 | 4/1991 | Counsel et al. | 439/783 |
| 5,044,996 | 9/1991 | Goto | 439/783 |
| 5,244,422 | 9/1993 | Laricchia | 439/783 |
| 5,507,671 | 4/1996 | Chadbourne et al. | 439/783 |
| 5,538,447 | 7/1996 | Chadbourne et al. | 439/783 |
| 5,558,546 | 9/1996 | Chadbourne et al. | 439/783 |
| 5,679,031 | 10/1997 | Chadbourne et al. | 439/783 |

FOREIGN PATENT DOCUMENTS

| | | |
|---|---|---|
| 2 070 302 | 6/1992 | Canada . |
| 0 653 802 A1 | 5/1995 | European Pat. Off. . |

*Primary Examiner*—Gary F. Paumen
*Attorney, Agent, or Firm*—Perman & Green, LLP

[57] ABSTRACT

An electrical connector with a wedge and a shell. The shell has a general "C" shaped cross-section. Opposite ends of the shell have outwardly flared shapes. Burrs are provided at junctions of the outwardly flared shapes with the rest of the shell.

20 Claims, 2 Drawing Sheets

WEDGE CONNECTOR SHELL WITH FLARED ENDS AND BURRS

BACKGROUND OF THE INVENTION

1. Field of the Invention

The present invention relates to electrical connectors and, more particularly, to a wedge connector.

2. Prior Art

European Patent Application publication No. 0653802 discloses a wedge connector shell with radially arranged stiffening recesses and holding teeth. Canadian Patent Application 2,070,302 discloses a wedge connector with teeth. U.S. Pat. No. 5,044,996 discloses a wedge connector having a C-member with an inwardly projecting lance to engage the wedge. U.S. Pat. No. 4,650,273 discloses an electrical connector with a general "C" shaped sleeve and a wedge. The wedge is stamped and formed from sheet metal and has a tab at its front end. The tab engages a front end of the sleeve to resist withdrawal of the wedge from the sleeve. U.S. Pat. No. 5,006,081 discloses a wedge connector with a "C" shaped sleeve having a hole in its middle section for engaging a dimple on a stamped and formed sheet metal wedge. U.S. Pat. No. 5,244,422 discloses a wedge connector with a C-member having an inner surface of each channel with a knurled finish.

SUMMARY OF THE INVENTION

In accordance with one embodiment of the present invention, a wedge connector is provided comprising a wedge and a shell. The shell is suitably sized and shaped to receive the wedge and at least one conductor in a receiving area with the conductor being sandwiched between the wedge and the shell. The shell has a wedge entrance end and an opposite end. At least one of the ends has a general outwardly flared shape.

In accordance with another embodiment of the present invention, a wedge connector is provided comprising a wedge and a shell. The shell is suitably sized and shaped to receive the wedge and a conductor in a receiving area with the conductor being sandwiched between the wedge and the shell. The shell has a curved wall against which the conductor is located. The curved wall has a first bent section with a side generally facing an inward direction of the shell towards a center longitudinal axis of the shell. The bent section has an angle greater than 180° on the side facing the inward direction. The shell further comprises a burr extending inward at the bent section.

In accordance with one method of the present invention, a method of forming a shell for a wedge connector is provided comprising steps of forming a general cross sectional C-shaped member; and forming an outward flared section at an end of the member.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
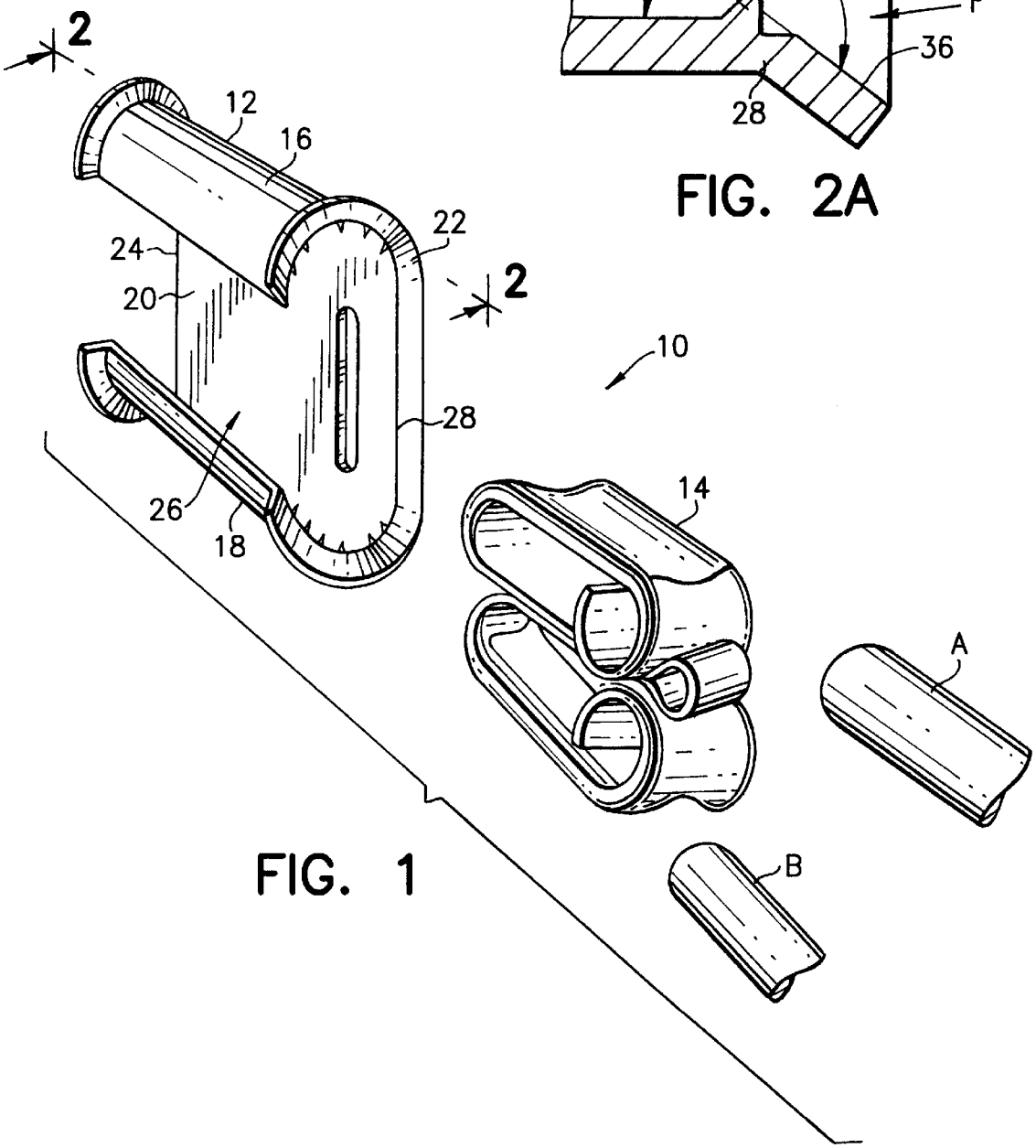
FIG. 1 is an exploded perspective view of a wedge connector incorporating features of the present invention and two electrical conductors.

Referring to FIG. 1, there is shown an exploded perspective view of a wedge connector 10 incorporating features of the present invention for connecting two electrical conductors A, B together. Although the present invention will be described with reference to the single embodiment shown in the drawings, it should be understood that the present invention can be embodied in many alternate forms of embodiments. In addition, any suitable size, shape or type of elements or materials could be used.

The connector 10 generally comprises a connector sleeve or shell 12 and a wedge 14. The shell 12 is preferably made of sheet metal, but it could also be a cast, drawn, or extruded member. The shell 12 has two opposing channel sections 16, 18 interconnected by a middle section 20 to form a general cross sectional C-shape. The cross-sectional C-shape tapers from the rear end 22 to the front end 24.

The wedge 14 is suitably sized and shaped to be inserted into a receiving area 26 of the shell 12, through the rear entrance end 22, and sandwich the conductors A, B against the respective inside surfaces of the channel sections 16, 18. The wedge 14 is described in more detail in U.S. Pat. No. 5,507,671 which is hereby incorporated by reference in its entirety. However, in an alternate embodiment, any suitable type of wedge could be used.

Figure 2A:
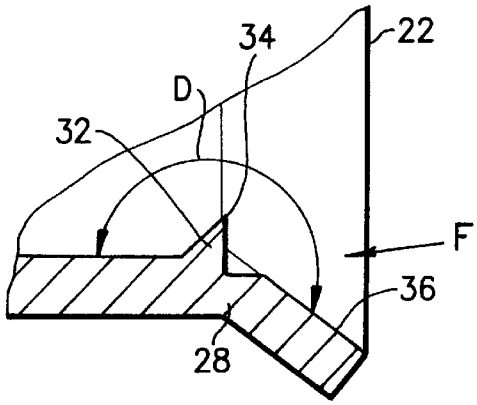
FIG. 2A is an enlarged view of area 2A shown in FIG. 2.
Figure 2:
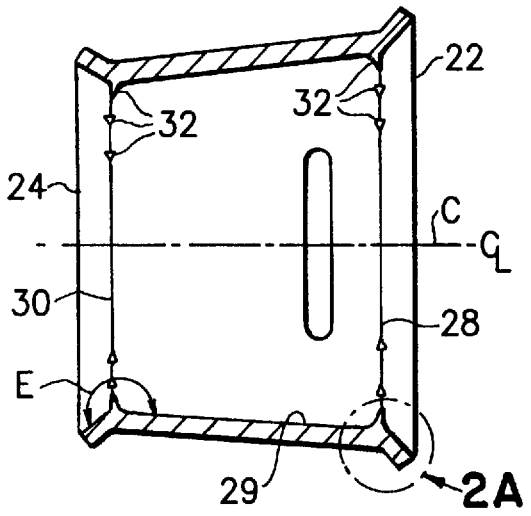
FIG. 2 is a cross-sectional view of the shell of the connector shown in FIG. 1 taken along line 2—2.
Figure 3:
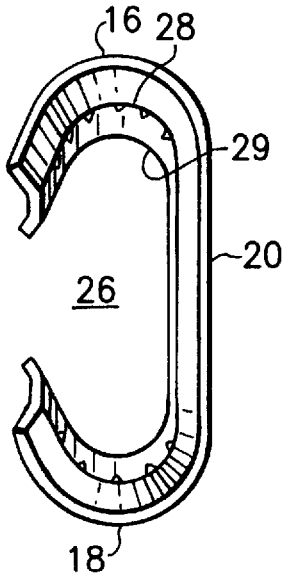
FIG. 3 is an elevational end view of the shell shown in FIG. 1.

Referring also to FIGS. 2 and 3, the ends 22, 24 of the shell 12 have outwardly flared shapes. The rear entrance end 22 has a bent section 28. The bent section 28 is the start of the outward flare at the rear entrance end 22 and forms a junction between the rear end outward flare and the rest of the shell. An inside surface 29 of the shell at the bent section 28 generally faces an inward direction towards a center longitudinal axis C of the shell 12. The opposite end 24 of the shell 12 also has a bent section 30. The inside surface 29 of the shell at the bent section 30 also generally faces the center longitudinal axis C. Referring also to FIG. 2A, the shell 12 has a plurality of burrs 32. The burrs 32 are located on the inside surface 29 at the curved walls of the channel sections 16, 18. More specifically, the burrs 32 are located at the junctions or bent sections 28, 30 on their inwardly facing sides. The bent sections 28, 30 both have angles D and E, on the side facing the inward direction, of greater than 180°.

In order to form the shell 12, a flat piece of sheet metal is cut. A tool (not shown) is then used to pierce into the sheet metal piece at an angle as indicated by arrow F to form the burrs for the bent section 28. The piercing causes a raised tip or edge 34 to be formed for each burr. The tip or edge has been found to be extremely sharp. If angle F is revered, ramp sections could be formed behind the tip 34 to help guide the conductor over the tips 34 during insertion. The tool is also used to pierce into the sheet metal piece at an angle generally reverse to arrow F to form the burrs for the front bent section 30. The burrs on the two bent sections 28, 30 are respectively angled in general opposite directions. However, in alternate embodiments, the burrs could all point towards the front of the shell. In another alternate embodiment, the burrs need only be provided at the rear bent section 28. Once the burrs 32 are formed, the flat piece is then deformed into its final shape by forming the general cross-sectional "C" shape and forming the outwardly flared shapes to the ends 22, 24. The burrs could also be formed after the "C" shape has been formed. The angle of piercing by the tool in direction F would then be at an acute angle to surface 36. In another alternate embodiment only one end might have the flared shape.

The flared shape of the ends 22, 24 has been provided to stiffen the shell 12. This increases the clamping load on the conductors A, B trapped between the wedge 14 and the shell 12. In alternate embodiments, stiffening by use of additional or alternative stiffening grooves, such as in EP 0653802, could be provided. The burrs 32 have been provided at the junctions of the flared ends with the rest of the shell to bite into and grip the conductors A, B. Thus, the flared ends add stiffness and increase clamping force while the burrs bite into the conductors for gripping. These features are provided from a flat sheet metal piece which can be manufactured at a relatively inexpensive cost.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A wedge connector comprising:

a wedge; and a shell suitably sized and shaped to receive the wedge and at least one conductor in a receiving area with the conductor being sandwiched between the wedge and the shell, the shell having a wedge entrance end and an opposite end, wherein at least one of the ends has a general outwardly flared shape.

2. A wedge connector as in claim 1 wherein the shell is comprised of sheet metal.

3. A wedge connector as in claim 1 wherein the shell has a general "C" shape.

4. A wedge connector as in claim 1 wherein both of the ends have an outwardly flared shape.

5. A wedge connector as in claim 4 wherein at least one of the ends has burrs facing an inward direction at a junction of the outwardly flared shape with the rest of the shell.

6. A wedge connector as in claim 4 wherein both ends have inward facing burrs at junctions of their respective outward flared shapes with the rest of the shell.

7. A wedge connector as in claim 6 wherein the burrs at the entrance end are angled in a direction generally opposite to a direction of the burrs at the opposite end.

8. A wedge connector as in claim 1 wherein the at least one end has burrs facing an inward direction at a junction of the outwardly flared shape with the rest of the shell.

9. A wedge connector as in claim 8 wherein the burrs have angled sharp tips formed by piercing into the shell at an angle under the tips.

10. A wedge connector comprising:

a wedge; and a shell suitably sized and shaped to receive the wedge and a conductor in a receiving area with the conductor being sandwiched between the wedge and the shell, and the shell having a curved wall against which the conductor is located, the curved wall having a first bent section with a side generally facing an inward direction of the shell towards a center longitudinal axis of the shell, the bent section having an angle greater than 180° on the side facing the inward direction, and the shell further comprising a burr extending inward at the bent section.

11. A wedge connector as in claim 10 wherein the shell is comprised of sheet metal.

12. A wedge connector as in claim 10 wherein the shell has a general "C" shape.

13. A wedge connector as in claim 10 wherein the bent section is located at an end of the shell and forms an outwardly flared section.

14. A wedge connector as in claim 10 wherein the burr has an angled sharp tip formed by piercing into the shell at an angle under the tip.

15. A wedge connector as in claim 14 wherein the shell has a second bent section with a burr extending inward from the second bent section.

16. A wedge connector as in claim 15 wherein the burrs at the first bent section and the second bent section are respectively angled in general opposite directions to each other.

17. A wedge connector as in claim 16 wherein the burr at the first bent section generally faces in a direction towards the burr at the second bent section.

18. A method of forming a shell for a wedge connector, the method comprising steps of:

forming a general cross-sectional "C" shaped member; and forming an end of the member as an outwardly flared shape.

19. A method as in claim 18 wherein the step of forming the general "C" shaped member comprises deforming flat sheet metal into a general "C" shape.

20. a method as in claim 19 further comprising piercing into the member at an angle to form a sharp tip burr at a junction of the outward flared section with a rest of the member.

* * * * *